United States Patent [19]

Sloop, Sr.

[11] Patent Number: 4,793,164

[45] Date of Patent: Dec. 27, 1988

[54] LOCKING ASSEMBLY FOR UTILITY METER BOXES

[76] Inventor: Clifford E. Sloop, Sr., P.O. Box 1574, Columbus, Ga. 31906

[21] Appl. No.: 30,298

[22] Filed: Mar. 23, 1987

Related U.S. Application Data

[63] Continuation of Ser. No. 803,257, Dec. 2, 1985, abandoned.

[51] Int. Cl.[4] ..... B65D 55/14

[52] U.S. Cl. ..... 70/164; 70/DIG. 57; 70/34

[58] Field of Search ..... 70/23, 32–34, 70/158, 162–173, 417, DIG. 57, 159–161; 292/304, 301, 206, 105

[56] References Cited

U.S. PATENT DOCUMENTS

| | | | |
|---|---|---|---|
| 4,120,182 | 10/1978 | Mickelman | 70/34 |
| 4,158,953 | 6/1979 | Nielsen | 70/164 |
| 4,329,860 | 5/1982 | Moberg | 70/164 |
| 4,413,490 | 11/1983 | Nielsen | 70/164 |

*Primary Examiner*—Robert L. Wolfe

*Attorney, Agent, or Firm*—Hurt, Richardson, Garner, Todd & Cadenhead

[57] ABSTRACT

A locking assembly for utility meter boxes is disclosed, the assembly designed for connection to the meter box at the latch portion or the point of access to the box. The assembly has a bracket member for connection to the meter box and a cover member for engaging the bracket member and forming an enclosure around the point of access. A lock retaining member is disposed within this enclosure for engaging and retaining a lock therein, thereby preventing unauthorized removal of the cover member.

6 Claims, 6 Drawing Sheets

LOCKING ASSEMBLY FOR UTILITY METER BOXES

This is a continuation of copending application Ser. No. 803,257 filed on Dec. 2, 1985 and now abandoned.

BACKGROUND OF THE INVENTION

Utility meter boxes are supplied by the utility companies to their customers and are somewhat standardized in type and appearance. Such boxes have a common purpose, that of metering electrical or other usage to determine what is owed to a utility company for the service. When a meter is installed, it is common practice for the installer to attach a locking wire clip or similar device at the latch portion of the meter, which can only be removed by essentially destroying the clip or device. This serves as an indicator for the utility company to determine whether a meter may have been tampered with. A typical indicator is a thin copper wire with a lead clasp. The meter box is closed and the wire is threaded through the latch, whereupon the lead clasp is clamped down on the wire with a plier-like device which stamps the installer's code number in the soft lead. Such a device is little deterrent to a potential tamperer.

Most meter boxes are supplied in one of two general embodiments, those with locking rings securing a translucent globe or cover over the viewing window, or those with a translucent cover that is secured over the viewing window by a rim formed in the door of the meter. The translucent covers, normally of glass or plastic, are subject to breakage by thieves or vandals, and thus, present a troublesome security problem.

The theft of services from utility companies is an especially widespread problem. Customers who do not pay for the electrical or other services and have their meter disconnected often break into the meter and reconnect the line. Another common problem involves theft of services by those who break into and adjust their meter downwardly to reflect a lower than actual usage. The utility companies have developed many different devices and methods to try to prevent such occurrences; however, those stealing the service have been equally as inventive.

Since the meters must be accessible to servicemen and other utility company employees in case of problems or breakdown of the meter, they can be opened. Consequently, unauthorized persons have also been able to bypass or defeat current security devices.

This also presents safety problems. For example, the main power lines running into an electrical meter box normally carry relatively high amperage current which is then divided into the multiple lower-amperage circuits which extend throughout the structure. Thus, unauthorized entrants risk severe injury from electrical shock due to lack of safety knowledge and procedures.

SUMMARY OF THE INVENTION

It is, therefore, one of the principal objects of the present invention to provide a locking assembly for meter boxes which provides a high degree of security against intrusion by unauthorized entrants, and which has several embodiments of the locking assembly for installation on most of the diverse types of meters currently in use.

Another object of the present invention is to provide a locking assembly for meter boxes which is easily accepted by most types of meter boxes, and which requires no specialized skill or training to install.

A further object of the present invention is to provide a locking assembly for meter boxes which can be easily and inexpensively manufactured and which is durable to provide a long service life.

These and additional objects are attained by the present invention which relates to a locking assembly for utility meter boxes having a bracket member for connection to the meter box and a closure means for covering the bracket member. Disposed within this assembly is a lock retaining means which receives and secures a lock of suitable type for preventing the removal of the closure means and thus, access to the underlying connection of the bracket member with the meter box.

Several embodiments are presented herein having this basic structure, slight variations being present to accommodate the various meter box structures. The present locking assembly components may be produced from a sturdy metal or plastic and are easily installed on the meter boxes. The application will generally focus on electrical meter boxes; however, its application is not meant to be limited thereby in any way.

Various additional objects and advantages will become apparent from the below description, with reference to the accompanying drawings.

DETAILED DESCRIPTION OF THE PREFERRED EMBODIMENT

Figure 1:
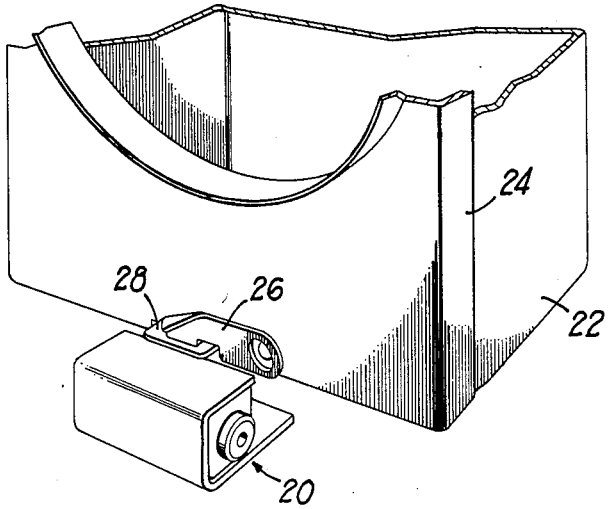
FIG. 1 is a partial, perspective view of one embodiment of the present locking assembly for meter boxes, shown here in installed position.
Figure 2:
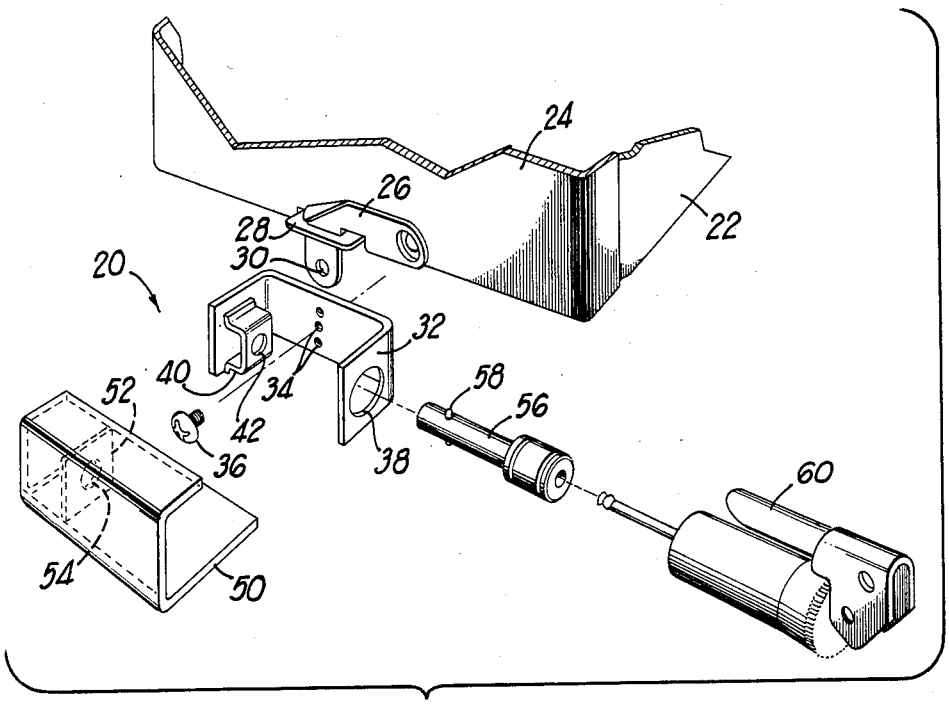
FIG. 2 is an exploded view of the locking assembly shown in the preceding figure.

Referring now more specifically to the drawings, and to FIG. 1 in particular, numeral 20 designates generally one embodiment of a locking assembly for utility meter boxes. The present invention is installed over the point of entry or the access point of a meter box, which is either the latch portion of the box or the point at which the locking ring is secured. The meter box 22 has a door 24 which is normally hinged at the top and opens at the bottom to allow access to the inside of the box. As shown in FIG. 2, the door has a hasp 26 which pivots to engage a slotted projection 28 that extends outwardly from box 22. The hasp has an aperture 30 which normally receives the indicator wire discussed hereinabove, or a small padlock.

The present locking assembly attaches to the hasp using aperture 30. A bracket member 32, having a plurality of attachment holes 34, is secured to the hasp with a suitable securing means, such as screw 36. In this particular arrangement, the indicator wire (not shown) may also be incorporated with aperture 30 in any convenient manner. The bracket member has an aperture 38 on one end thereof for receiving a locking device, and a lock retaining means 40 with an aperture 42 for keeping the lock secured within the bracket, the operation of which will be explained below.

Figure 3:
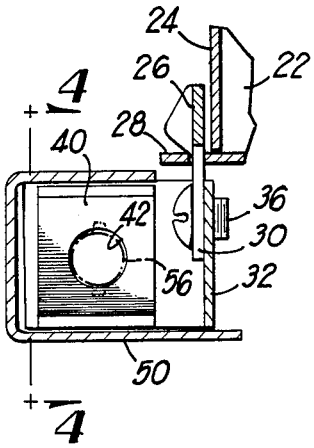
FIG. 3 is a side elevational view, shown partially in cross section showing the lock installed in the present locking assembly.
Figure 4:
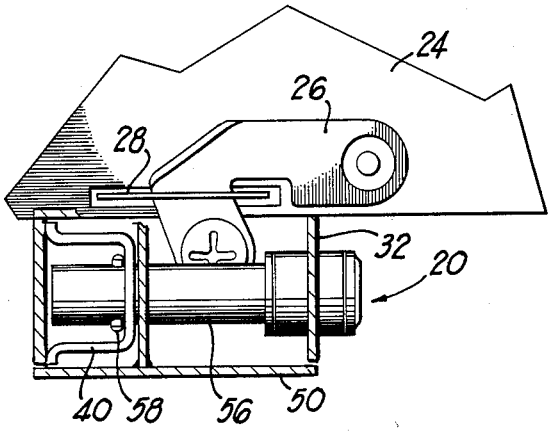
FIG. 4 is a cross sectional view of the assembly, the section being taken on line 4—4 of FIG. 3.

With the bracket installed, a closure means 50 is slid over the bracket. The closure or cover means has a plate member 52 disposed therein with an aperture 54 for receiving a portion of the locking device. As shown in FIG. 2, the locking device is a conventional barrel lock 56. The barrel lock has protrusions 58 near the distal end thereof which have extended and locked, or retracted and unlocked positions. A special key 60 is used to act on a spring-loaded mechanism inside the barrel lock. For example, with the key inserted and the key handle raised, the plunger of the key acts on the spring mechanism to release the tension on the protrusions 58. The barrel lock is then inserted through apertures 38, 54 and 42 respectively, and the key handle is lowered to lock the protrusions in an extended position, as shown in FIGS. 3 and 4. The locking assembly thus secured is shown in FIG. 1, with the hasp and the indicator wire protected from unauthorized tampering.

Figure 5:
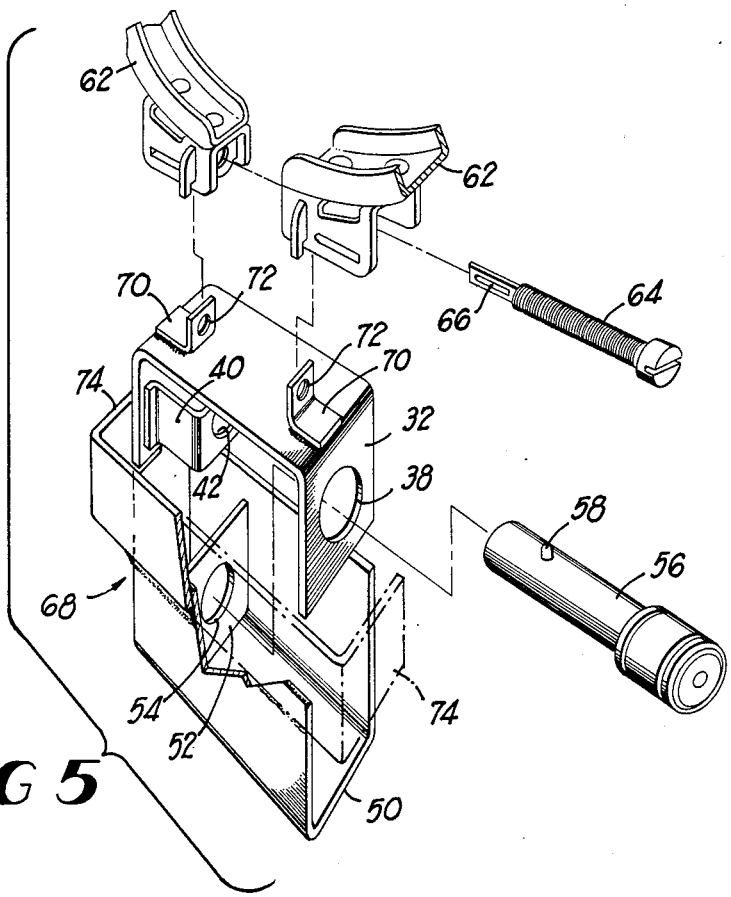
FIG. 5 is an exploded perspective view of another embodiment of the present locking assembly, here designed for electrical meters having a locking ring.
Figure 6:
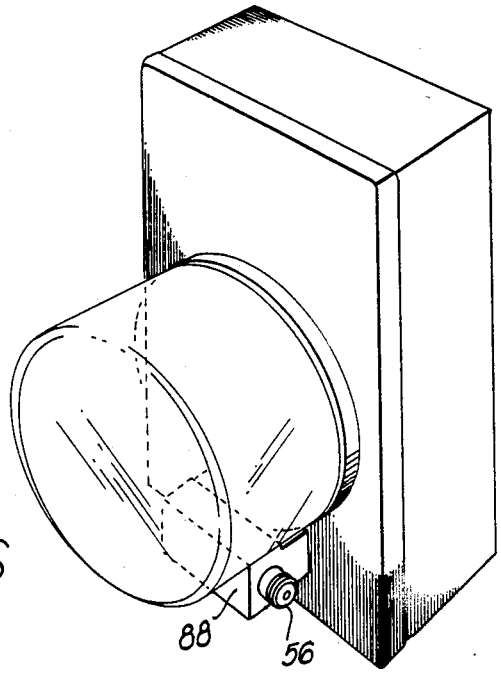
FIG. 6 is a perspective view of another embodiment of the present invention, shown here installed on a meter box with a locking ring.

An alternate embodiment of the present locking assembly is shown in FIG. 5. This embodiment is designed for use on electrical meter boxes which have locking rings that hold a translucent, bubble-type cover, the general type being shown in FIG. 6. In this arrangement, locking ring 62 engages a flange on the meter box and a flange on the translucent cover, holding the two flanges together. The split ring is then secured in any convenient manner, as with screw 64, the screw drawing the ring around the flanges as it is tightened. Normally, an indicator wire (not shown), would then be secured through slot 66 in screw 64, or some similar arrangement would be used to indicate tampering. This arrangement provides little, if any, security.

This alternate embodiment of the present locking assembly is designated generally by numeral 68 in FIG. 5. The same bracket member 32, is used, it being disposed ninety degrees from the embodiment shown in FIGS. 1 through 4, and has tab members 70 secured, as by welding, to the now upper face thereof. The tab members are spaced apart a sufficient distance to impart a slight tension to the ring, thereby holding the bracket member and ring together while leaving both hands free for installing screw 64. The tab members have apertures 72 formed therein for receiving screw 64 as it is threaded through the split locking ring. The closure means 50 is also the same as in the first embodiment, except for an extended wall portion 74, which is added, as by welding, to cover the attachment site of screw 64 in the locking ring 62 and prevent tampering therewith. Once assembled, the barrel lock 56, or a similar device, is inserted through apertures 38, 54 and 42, respectively, thereby securing the assembly.

Figure 7:
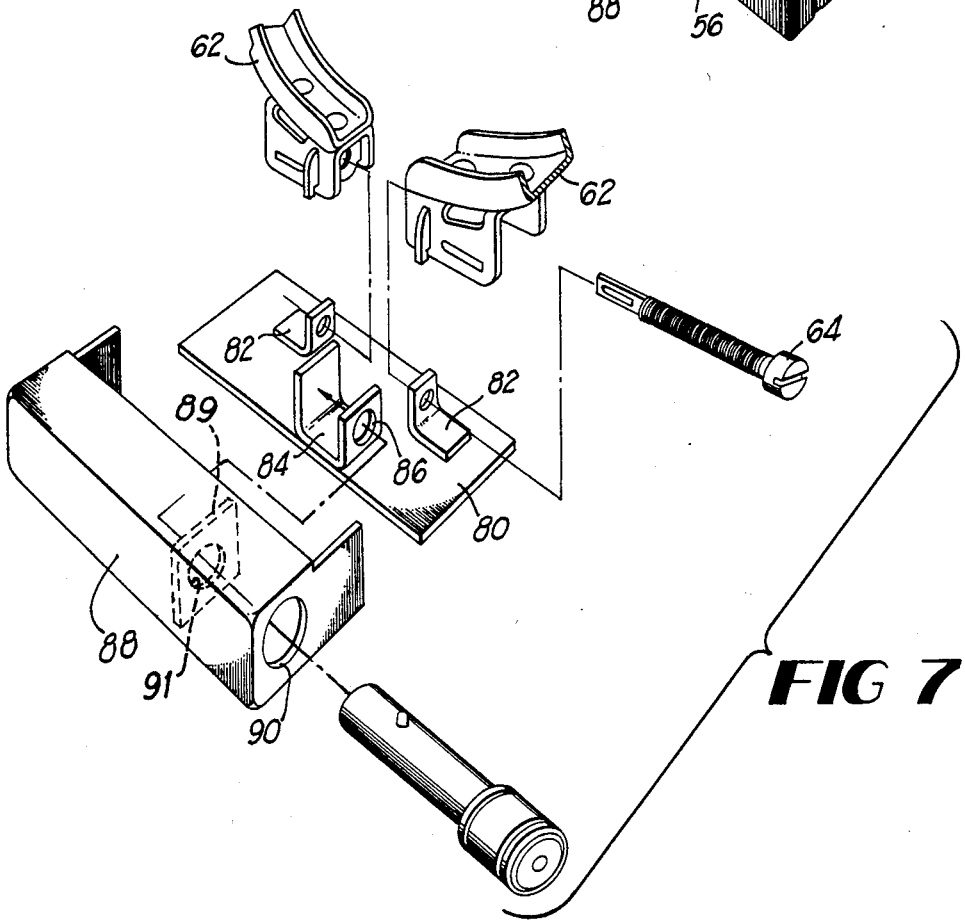
FIG. 7 is an exploded perspective view of the locking assembly shown in the preceding figure.
Figure 8:
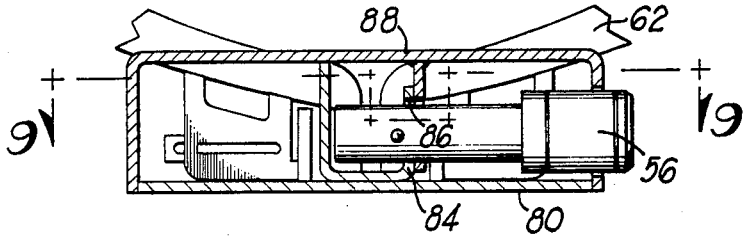
FIG. 8 is a front elevational view, shown partially in cross section, of the locking assembly shown in the preceding figure.
Figure 9:
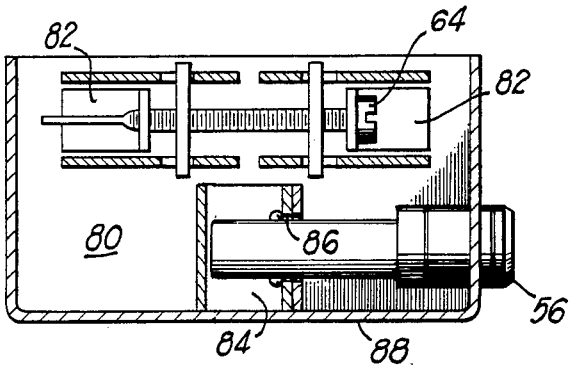
FIG. 9 is a cross sectional view, taken on line 9—9 of FIG. 8.

FIGS. 6 through 9 illustrate a third embodiment of the present locking assembly. The assembly is designed to accommodate a slightly different type of meter box with a locking ring; however, the same basic components are used. A bracket member 80 has tabs 82 which receive screw 64 for securing the bracket member to the locking ring 62. A lock retaining means 84 with an aperture 86 is also secured to the bracket member for receiving the lock and securing the cover means 86. The closure means also has an aperture 90 through which the barrel lock 56 is inserted, and a plate means 89 secured therein, with an aperture 91 for receiving and retaining the lock, as shown in FIGS. 7 through 9. The protrusions 58 engage the wall of lock retaining means 84 upon passing through aperture 86. The cover is thereby secured over the attachment screw 64, preventing unauthorized tampering with the connection and the meter.

Figure 10:
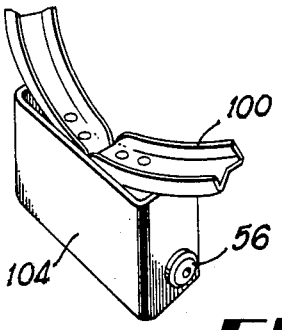
FIG. 10 is a partial perspective view of another embodiment of the present locking assembly, shown in installed position.
Figure 11:
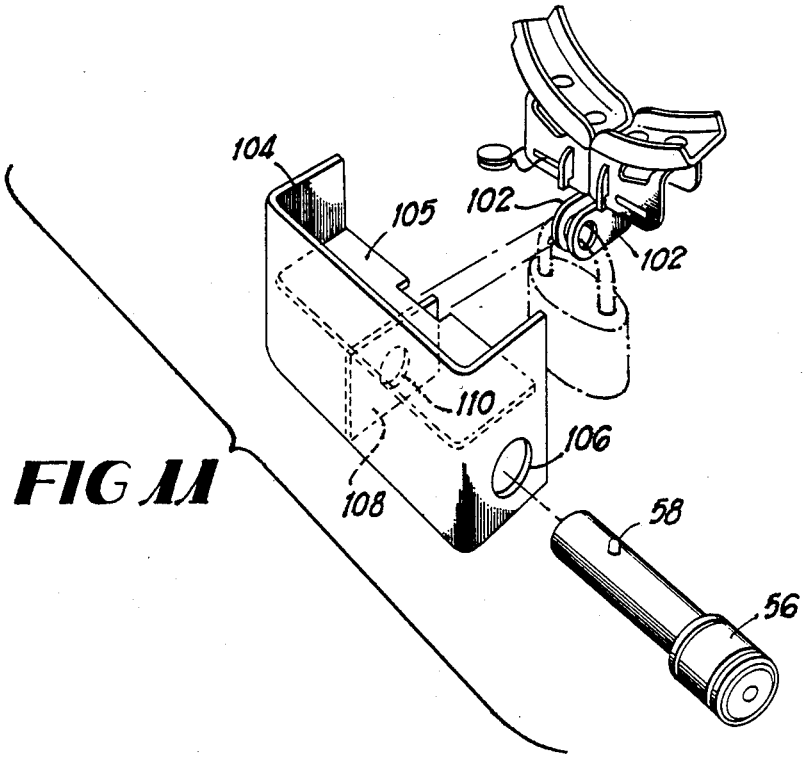
FIG. 11 is an exploded perspective view of the locking assembly shown in the preceding figure.

A fourth embodiment, employing the same basic features, but designed for a slightly different locking ring, is shown in FIGS. 10 and 11. This particular ring 100 is fastened together with a screw like the previously shown rings, but has tabs 102 secured thereto for receiving an indicator wire or a padlock. Such an arrangement, like the previous arrangements, is easily subject to tampering, thus, closure means 104 is added. The cover means has a bracket member 105 disposed therein, and an aperture 106 for receiving a lock. A lock retaining means 108 is disposed within the cover means for receiving the protrusions 58 of the barrel lock 56, through aperture 110 of the lock retaining means. When assembled, as shown in FIG. 10, the lock retaining means is disposed between the tabs 102 and the ends of the locking ring are securely encased and protected from tampering, the lock extending through tabs 102.

Figure 13:
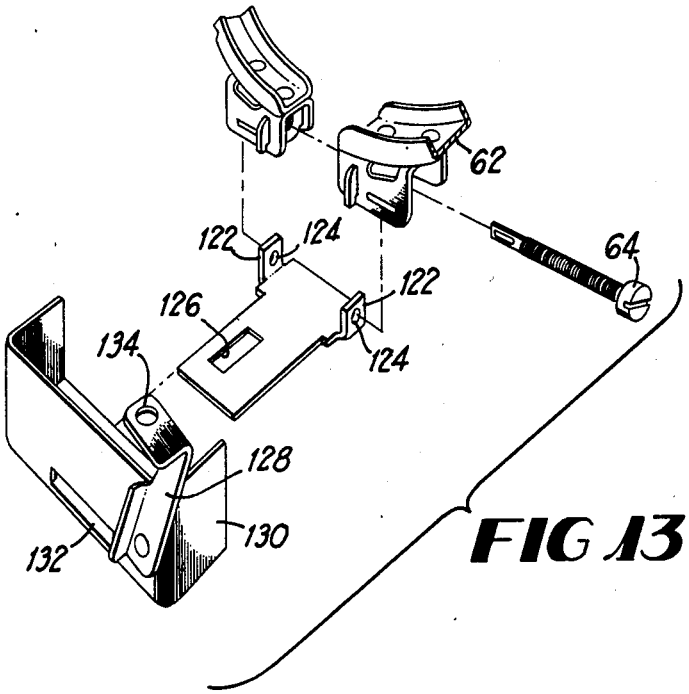
FIG. 13 is an exploded perspective view of the locking assembly shown in the preceding figure.
Figure 12:
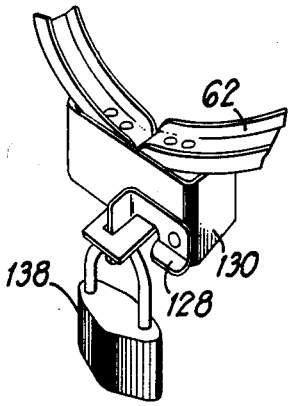
FIG. 12 is a partial perspective view of another embodiment of the present locking assembly, shown in installed position.

A fifth embodiment, also employing the same basic features, and designed to accommodate the locking ring 62 shown in FIG. 5, is shown in FIGS. 12 and 13. As seen in the exploded FIG. 13, a bracket member 120 is secured to ring 62 by screw 64. The bracket 120 includes tabs 122 with apertures 124 therein for receiving screw 64. The bracket member projects radially from the attachment to ring 62 and has a slot 126 formed therein for receiving a hasp 128 on the closure means 130. The radially projecting portion, including slot 126, extends through a slot 132 formed in the cover means, and the hasp pivots downwardly, the distal end 124 thereof engaging slot 126. The hasp has an aperture 136 formed in said distal end for receiving a suitable locking means, such as padlock 138, the completed assembly being shown in FIG. 12.

Figure 15:
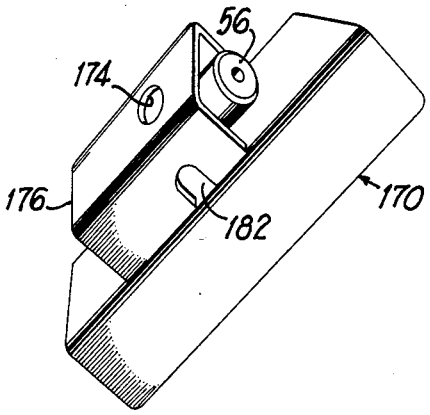
FIG. 15 is a perspective view of the locking assembly shown in the preceding figure shown herre in installed position with a conventional barrel lock.
Figure 16:
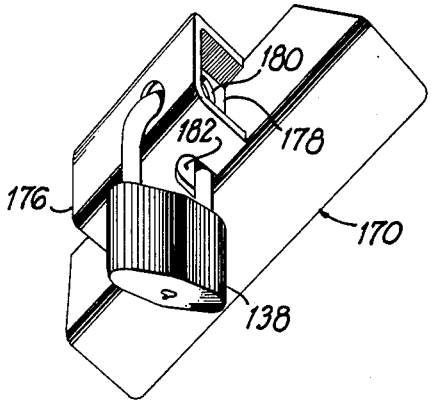
FIG. 16 is a perspective view of the locking assembly shown in FIG. 14, shown here in installed position with a conventional padlock.
Figure 14:
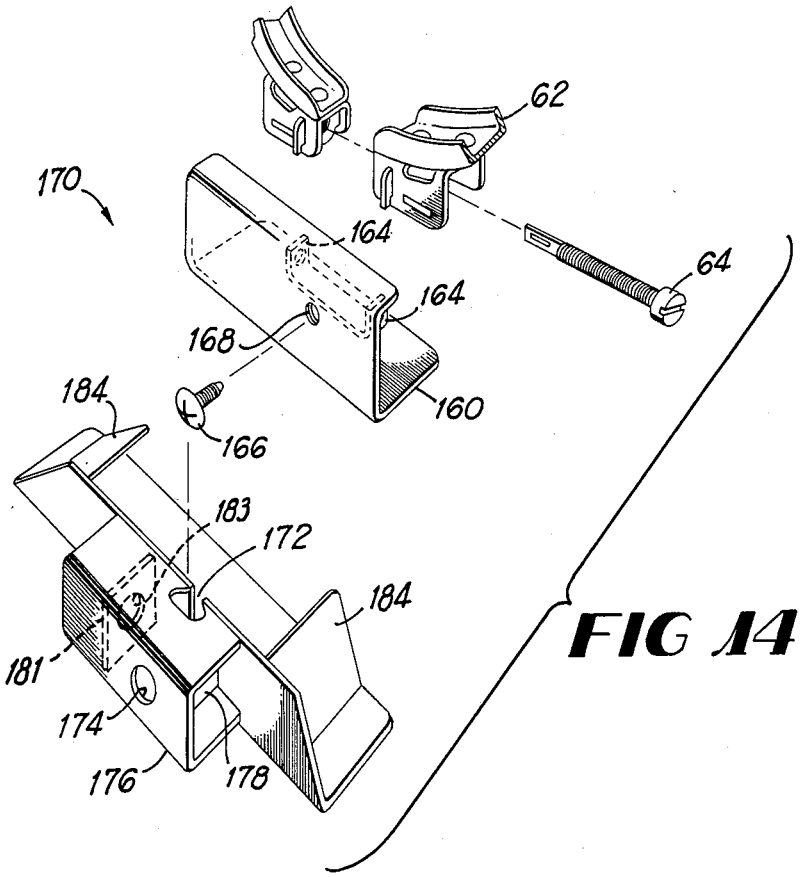
FIG. 14 is an exploded perspective view of another embodiment of the present locking assembly.

FIGS. 14 through 16 illustrate a sixth embodiment of the present invention, again having features common to the prior embodiments and designed to accommodate electrical or other meters with a locking ring 62 and screw 64. This embodiment provides a high degree of security and can accommodate different types of locks. The assembly has a bracket member 160 with tab means 162 mounted thereon for receiving screw 64 and securing the bracket member to the locking ring. With the bracket secured to the ring, a suitable fastening means, such as screw 166 is partially inserted into a corresponding aperture 168 in the bracket member.

As shown in FIG. 15, a closure means 170 or cover is provided, having a slot 172 formed therein for receiving the head of screw 166. With the screw only partially inserted, yet secured in the hole, the cover means may be temporarily hung on the bracket member, using slot 172. A screw driver (not shown) may then be inserted through an aperture 174, formed in the front portion 176 of cover means 170, to tighten screw 166 and secure the cover to the bracket. The front portion 176 also has a lock receiving means or plate 178 disposed therein with an aperture 180, for receiving barrel lock 56 or a similar device, as shown in FIG. 15. The front portion has a second lock retaining means or plate member 181 disposed therein with an aperture 183 for receiving the lock, plate 181 being disposed to the left of plate 178 as viewed in FIGS. 14 through 16. In the alternative, the front portion 176 is also provided with a bottom aperture 182 which, as shown in FIG. 16, cooperates with aperture 174 to receive a conventional padlock 138.

The insertion of either type of lock prevents access to screw 166 and, therefore, the removal of the cover means without first removing the lock. Two additional security measures are also provided. Both bracket member 160 and cover means 170 have base portions which are overlapped upon installation, thus providing a double thickness and making the bottom wall more drill-resistant. The second security feature is the provision of side plates 184 on the cover means 170. Plates 184 are angled inwardly toward the center of the cover means to prevent a drill bit from gaining a grip thereon. Thus, attempting to drill through the cover means by way of these side plates would only result in the drill bit slipping downwardly toward the base and away from the secured locking ring. Since the glass or plastic cover extends outwardly from the locking ring, over the present locking assembly, and effectively hinders access thereto, an unauthorized potential entrant is presented with a formidable security device.

In general, the use and operation of the various embodiments depends partly on the particular meter box. As presented hereinabove, some boxes have a sealed viewing window and the front of the box is hinged to permit access, while others have a locking ring encircling the viewing window or globe, through which access is gained by removing the window. The present invention accommodates either of these types with security features common to each of the embodiments.

In each, the bracket member is attached, in a suitable manner, to the meter box and a closure means is disposed around or over the bracket member, thereby forming an enclosure which protects the point of connection of the bracket member with the meter box. Within this enclosure is a lock retaining means which secures a suitable lock for preventing unauthorized removal of the cover means. Thus, unauthorized entry to the meter box is substantially prevented, thereby greatly reducing the theft of utility services. While focusing on electrical meter boxes, some of the embodiments could also be applied to the meters of other types of utilities, and the discussion herein is not meant to limit the applications in any way.

While an embodiment of a locking assembly for utility meter boxes and modifications thereof have been shown and described in detail herein, various other changes and modifications may be made without departing from the scope of the present invention.

I claim:

1. In a utility meter box enclosure having a covering device for said enclosure and a securing means for maintaining said covering device in secured relationship with said enclosure, a locking assembly for said enclosure, wherein the improvement comprises a bracket member connected to said securing means for said enclosure, a closure means for substantially encompassing said bracket member for preventing unauthorized access to said securing means, a lock retaining means disposed within and secured to said closure means, and a locking means for engaging said lock retaining means and preventing unauthorized removal of said closure means.

2. A locking assembly as defined in claim 1 in which said lock retaining means is secured to said bracket member and includes a plate member having an aperture formed therein for receiving the lock.

3. A locking assembly as defined in claim 1 in which said lock retaining means is secured to said closure means and includes plate means having an aperture formed therein for receiving the lock.

4. A locking assembly as defined in claim 3 in which said lock retaining means includes a plate member secured to said bracket member and having an aperture formed therein for receiving the lock.

5. In a utility meter box enclosure having a covering device for the enclosure and a means for securing said covering device to said enclosure including a locking ring secured by a screw or the like, a locking assembly comprising a bracket member having a wall portion with a U-shaped member secured to said wall portion, said U-shaped member having an aperture therethrough for receiving a locking means, tab means secured to said bracket member and having apertures formed therein for receiving said screw and attaching said bracket member to said locking ring, said tab means being spaced apart sufficiently to impart tension to said locking ring for initially holding said bracket member in contact with said ring, and a closure means for substantially enclosing said bracket member, said closure means having a plate means secured therein and having an aperture therethrough in substantial alignment in said aperture in said U-shaped member when said bracket member and said closure means are in assembled relationship, said first and second apertures being engaged by the locking means for securing said closure means to said bracket member.

6. A locking assembly as defined in claim 5 in which said closure means includes side members having upper and lower edges, said side members being angled inwardly toward the center of said closure means with lower edges disposed outboard from said upper edges.

* * * * *